United States Patent [19]

Audeh et al.

[11] 4,381,234

[45] Apr. 26, 1983

[54] SOLVENT EXTRACTION PRODUCTION OF LUBE OIL FRACTIONS

[75] Inventors: Costandi A. Audeh; Israel J. Heilweil; James R. White, all of Princeton, N.J.; Tsoung Y. Yan, Philadelphia, Pa.

[73] Assignee: Mobil Oil Corporation, New York, N.Y.

[21] Appl. No.: 208,905

[22] Filed: Nov. 21, 1980

Related U.S. Application Data

[62] Division of Ser. No. 37,967, May 11, 1979, Pat. No. 4,273,645.

[51] Int. Cl.[3] ..... C10G 21/10; C10G 21/16

[52] U.S. Cl. ..... 208/327; 208/323; 208/335; 208/338

[58] Field of Search ..... 208/327, 323, 335, 338

[56] References Cited

U.S. PATENT DOCUMENTS

| | | | |
|---|---|---|---|
| 2,338,384 | 1/1944 | Robinson et al. | 208/323 |
| 2,383,768 | 8/1945 | Buis et al. | 208/323 |
| 2,442,820 | 6/1948 | McCormick | 208/323 |

*Primary Examiner*—Edward S. Williams
*Assistant Examiner*—William Leader
*Attorney, Agent, or Firm*—Michael G. Gilman; Charles J. Speciale; Claude E. Setliff

[57] ABSTRACT

An improved solvent extraction process is described for the preparation of lube oil products, the improvement whereby the solvent contains an additive which facilitates phase separation and increases the yield of raffinate.

8 Claims, No Drawings

SOLVENT EXTRACTION PRODUCTION OF LUBE OIL FRACTIONS

This is a division of copending application Ser. No. 037,967, filed May 11, 1979, now U.S. Pat. No. 4,273,645.

BACKGROUND OF THE INVENTION

1. Field of the Invention

The invention relates to a process for producing lube oil fractions by solvent extraction. It more particularly relates to an improvement to such process whereby an additive is used with the solvent employed.

2. Discussion of the Prior Art

Solvent extraction is a well established process used in the refining of petroleum, the first application having been made in about 1911. Originally, upgrading of kerosine was a major use but the improvement obtained in solvent extracting lubricating oils and other products soon became an important application. Solvent extraction is used extensively in the petroleum refining industry to refine lubricating oils, kerosine and specialty oils for medicinal and agricultural purposes. Solvent extraction has also been used for the upgrading of charge stocks for catalytic cracking operations as well as the separation of light aromatics from gasoline. Solvent extraction is a process that separates hydrocarbon mixtures into two phases, a raffinate phase which contains substances of relatively high hydrogen to carbon ratio often called paraffinic type materials and an extract phase which contains substances of relatively low hydrogen to carbon ratio often called aromatic type materials. Therefore, it may be said that solvent extraction is possible because different liquid compounds have different solution affinities for each other and some combinations are completely miscible while other combinations are almost immiscible. The ability to distinguish between high carbon to hydrogen aromatic type and low carbon to hydrogen or paraffinic type materials is termed selectivity. The more finely this distinguishing can be done the higher the selectivity of the solvent.

SUMMARY OF THE INVENTION

In accordance with the invention there is provided an improved method for producing lubricating oils by solvent extraction which comprises contacting a lube oil-containing hydrocarbon charge under conditions of solvent selectivity to permit the recovery of a raffiniate phase, which, upon dewaxing, will provide a lube oil product of at least 90 V.I., the improvement whereby there is present in the extraction system from about 0.002% to about 0.2% by weight, preferably about 0.01% to about 0.1% by weight, of the solvent of an additive for increasing the yield of raffinate. Preferred among these are the demulsifier, and high molecular weight resins more particularly taught hereinafter.

DESCRIPTION OF SPECIFIC EMBODIMENTS

Oil is made up of compounds consisting of paraffins and of naphthenic and aromatic rings carrying side chains of varying number, length and structure. Long side chains are characteristic of molecules of high paraffinicity and high viscosity index, while polynaphthenic and polyaromatic structures with fewer and shorter chains will show low viscosity index and high viscosity-gravity constant. The division between compounds of long and short side chains, therefore, is necessarily not sharp and undoubtedly some constituents of high VI are lost in any extraction process. Furthermore, it has been demonstrated that the "purity" of a vacuum distillate plays an important role in its solvent extraction characteristics. For example, laboratory settling time, at equilibrium phase separation, as well as extraction yield at a commercial extraction unit, are related to distillate quality and its deterioration. In searching for a chemical method for improving the separation qualities of a distillate during extraction without the necessity of upgrading such distillate led to the discovery of a class of additives having the requisite properties. In addition to the fact that phase separation is enhanced, the yield of raffinate is also increased.

Terms which are used extensively in solvent extraction operations include "solvent" for the extracting agent, "solute" for the readily soluble material in the feed, "extract" for the material removed from the feed, "raffinate" for the non-dissolved product, and "reflux" for extract material returned to the extractor; "rich solvent" refers to the solvent extract solution withdrawn from the extractor.

Solvents which have been used in commercial operations include furfural, phenol, cresylic acid, nitrobenzene, dichloroethyl ether, sulfur dioxide and others. If desired, these solvents may be used in the presence of diluents such as benzene, carbon disulfide, ethers and carbon tetrachloride. Generally, the diluents increase the solubility of all of the hydrocarbons. The use of diluents, however, can reduce solvent selectivity.

Furfural is a preferred solvent extraction agent. Its miscibility characteristics and physical properties permit use with both highly aromatic and highly paraffinic oils of wide boiling range. Light and heavy lubricating stocks are usually refined with furfural. For lubricating oils it has been used in the prior art at elevated temperatures in the range of 120° F. and 290° F. and with from 1 to 4 volumes of furfural to 1 volume of oil. While this broad range of furfural to oil ratio can be used in our invention, we prefer to use a ratio of from about 1.0 to about 3.5, and more preferably from about 1.5 to about 2.8.

In a typical furfural solvent extraction plant for lubricating oils, the raw feed or distillate fraction, at a temperature of about 110° to about 250° F. and depending upon the nature of the oil, is introduced below or at about the center of the extraction tower. Furfural is fed into the top or upper portion of the tower at a temperature selected from within the range of about 150° F. to about 290° F. Recycle extract may be introduced into the lower section of the tower as reflux. Likewise, internal reflux is effected in the tower by the temperature gradient which is brought about by introducing the solvent at an elevated temperature and by intermediate cooling systems. Furfural solvent is recovered from the raffinate and extract phase streams or layers in suitable distillation and stripping equipment. The stripped and recovered solvent is then returned or recycled for use in the process as above described.

Finished lubricating base oils are generally divided into the following three broad grade classifications:

| | Viscosity Range, Saybolt Seconds Universal | Boiling Range, °F. |
|---|---|---|
| Light neutrals | 100–250 at 100° F. | 650–900° F. |
| Heavy neutrals | 350–750 at 100° F. | 850–1000° F. |

-continued

| | Viscosity Range, Saybolt Seconds Universal | Boiling Range, °F. |
|---|---|---|
| Bright stocks | 110–200 at 210° F. | >950° F. |

The light and heavy neutrals are normally produced from adjacent boiling vacuum tower distillates that are solvent extracted and dewaxed. The bright stock is produced from the vacuum tower residuum remaining after the light and heavy neutral distillates have been boiled off. The residuum is first deasphalted and the deasphalted oil is then solvent extracted and dewaxed. It has been found that these three grades of unrefined stocks from any given lube crude have markedly different refining requirements to achieve normal quality levels as measured by viscosity index. The heavier higher boiling stocks from a crude are more difficult to refine to a given viscosity index level than is the adjacent lower boiling fraction. Therefore under the conditions described in this invention, "high" viscosity index products from a given crude will vary with viscosity grade as follows:

| | High Viscosity Index Product |
|---|---|
| Light neutral | 95–115 |
| Heavy neutral | 95–105 |
| Bright stock | 90–100 |

These numerical V.I. levels thus represent equivalent extraction severities for the several viscosity grades of products. The V.I. rating of lubricating oil products can then be generally described in terms of any one of these viscosity grades in accordance with this relationship.

Crude oils are classified by the Bureau of Mines into three categories according to the predominant composition of their 736°–788° F. fraction as paraffinic, intermediate and naphthenic. Paraffinic crude such as Pennsylvania or High Pour Libyan crudes contain considerable amounts of wax, while some naphthenic crudes such as coastal crudes contain no wax. Intermediate crudes such as Mid-Continent, Kuwait or East Texas contain varying amounts of wax. Thus, it can be seen that crude source is especially important in the manufacture of premium lubricants as various lubricating duties require oils of different chemical composition and properties.

Results of a relatively broad literature review indicate that relatively high V.I. lube oil components, above about 120 V.I., are present in many crude lube oil fractions. However, recovery of these high V.I. components in a stable oil fraction has been the subject of considerable investigation. It has been found upon review of the prior art and literature methods for recovering high V.I. lube oil constituents that the processes employed are generally regarded as exotic extraction and distillation schemes which are of little or no commercial interest primarily because of cost involved.

Basically, all extraction proceses are similar. Each consists of facilities to contact the oil with a selective solvent that separates by extraction one or more types of the oil constitutents from other types of oil constituents plus facilities to separate solvent from the extract and raffinate streams thus obtained. The solvent must be recovered in substantially every circuit of the system. As large amounts of solvent are circulated, the heat requirements are high and unless employed in an extremely efficient manner, they constitute one of the major operating expenses. The extraction equipment proper is relatively simply, but the solvent recovery facilities are necessarily complex and therefore expensive and any means by which these costs or facilities can be simplified greatly contribute to the commercial interests of the process.

A wide variety of demulsifiers can be used in the practice of this invention. Among these are included those of the type having the formula $$R\text{-}CONH\text{-}CH_2CH_2SO_3Na$$

disclosed in U.S. Pat. No. 2,644,771, derivatives of quinoline and pyridine as in U.S. Pat. No. 2,334,390, N-alkylated sulfonamides as in U.S. Pat. No. 2,335,554, polyoxyethylene derivatives of alkylphenols as in U.S. Pat. No. 2,470,808, alkyl oxyalkeylene amines of U.S. Pat. No. 4,038,102, polyacrylamides as taught in several references, e.g. U.S. Pat. No. 3,633,310, and polyalkoxylated quaternary ammonium compounds exemplified in U.S. Pat. No. 3,689,298.

One class we have used to advantage are the hydrocarbyl sulfonic acid salts. By hydrocarbyl is meant an aryl group having another aryl group or an alkyl group attached thereto, such that the hydrocarbyl will have a total of from 7 to 37 carbon atoms. A specific example of compounds within this class are the alkylbenzene sulfonic acid salts, wherein the alkyl contains 1 to 30 carbon atoms, preferably 10 to 20 carbon atoms. Another class we have used includes high molecular weight polymers soluble in polar solvents. An example of compounds within this class is a polymer containing ethylene oxide units, more specifically polyethylene oxide resins.

Of the sulfonic acid salt demulsifiers indicated the metal may be taken from Groups IA, IIA and IIB of the Periodic Table, as, for example, sodium, calcium, barium and zinc, or the salt may be formed from the alkylbenzene sulfonic acid and $R'_4N^+$ where R' is hydrogen or a $C_1$–$C_6$ alkyl group.

In accordance with one embodiment of the invention, a hydrocarbon feed stock boiling about 650° F., such as a light or heavy neutral distillate (Arab Light) is extracted with furfural.

Having described the invention in broad, general terms, the following will illustrate some specific embodiments thereof.

EXAMPLE 1

This Example illustrates the improvement in raffinate yield using sodium dodecylbenzene sulfonate and an Arab Light stock distillate having the properties shown in Table 1.

TABLE 1

| | |
|---|---|
| Gravity, °API | 23.3 |
| Sp. Gravity, 60/60° F. | 0.9141 |
| Pour Point, °F. | 90 |
| Neut. No. | 0.02 |
| Aniline Point, °F. | 178.3 |
| Refraction Index, 70° C. | 1.4922 |

Furfural extraction of the stock distillate was carried out in two glass columns, 37 mm and 17 mm ID, packed with 250 ml. and 125 ml., respectively, of 0.24" Propak. The extraction columns were equipped with metering pumps heaters, heater controls and a level controller.

In this experiment furfural solvent was preheated to the required temperature, and pumped to enter the top of the extraction column at a point just above the packed section. Similarly, the distillate was preheated and metered to enter the column at a point near the bottom of the packing. At start up, the extraction was allowed to proceed until the settling and mixing zones were full and raffinate reached the top of the column. Raffinate and extract were then slopped for 6 hours before product was collected.

For runs in which conditions were changed, the extraction was allowed to continue during the change, followed by a 4–6 hour slop period.

Two streams were collected from this process, a raffinate phase and an extract phase. Both phases were then steam stripped to remove the solvent and the resultant raffinate and extract were submitted for the appropriate tests. The results are shown in the following table.

TABLE 2

FURFURAL EXTRACTION OF THE DISTILLATE AT 150° F. and 160% FURFURAL IN A CONTINUOUS 37 MM ID COLUMN

| % Wt. Additive in Solvent | Solvent Free Product | Yield % Vol. to Distillate | Gravity °API | Aniline Point, °F. | Refractive Index at 70° C. |
|---|---|---|---|---|---|
| 0 | Raffinate | 69 | 30.5 | 210.0 | 1.4638 |
| | Extract | 31 | 5.1 | 48.6 | 1.5716 |
| 0.04 | Raffinate | 73 | 30.7 | 211.9 | 1.4629 |
| | Extract | 27 | 5.3 | 47.6 | 1.5694 |
| 0.08 | Raffinate | 73 | 30.7 | 211.5 | 1.4633 |
| | Extract | 27 | 5.2 | 47.3 | 1.5698 |

The data obtained from the 37 mm ID glass column are summarized in Table 2. These data for 160% furfural dosage, and at 150° F., show the effect of the addition of small amounts of sodium dodecylbenzene sulfonate on the yield of raffinate using the same extraction conditions. Whereas without the detergent the yield of raffinate is 69% by volume of the distillate, with the detergent this increased to 73%. Changing the concentration from 0.04% by wt. of the added detergent to 0.08% does not appear to further increase the yield of raffinate or extract.

EXAMPLE 2

Example 1 was repeated except that the extraction dosage and temperature were changed as shown in Table 3 and the glass column was one having a 17 mm ID. Data for this column are summarized in Table 3. These data also demonstrate an increase in the raffinate yield.

TABLE 3

FURFURAL EXTRACTION OF THE DISTILLATE AT 190° F. and 180% FURFURAL IN A CONTINUOUS 17 MM ID COLUMN

| % Wt. Additive in Solvent | Solvent Free Product | Yield % Vol. to Distillate | Gravity °API | Aniline Point, °F. | Refractive Index at 70° C. |
|---|---|---|---|---|---|
| 0 | Raffinate | 50.1 | 33.3 | 224.5 | 1.4558 |
| | Extract | 49.9 | 14.2 | 118.5 | 1.5291 |
| 0.05 | Raffinate | 56.2 | 32.8 | 221.5 | 1.4576 |
| | Extract | 43.8 | 12.5 | 103.9 | 1.5381 |
| 0.10 | Raffinate | 54.4 | 32.9 | 223.3 | 1.4570 |
| | Extract | 45.6 | 12.6 | 103.0 | 1.5370 |
| 0.15 | Raffinate | 53.8 | 33.0 | 223.2 | 1.4568 |
| | Extract | 46.2 | 12.4 | 105.7 | 1.5372 |

EXAMPLE 3

This Example illustrates that dodecylbenzene sulfonate sodium salt also improves the yield of raffinate when using a heavy neutral distillate (Arab Light) having the following properties:

TABLE 4

| | |
|---|---|
| Gravity, °API | 18.8 |
| Sp. Gravity, 60/60° F. | 0.9415 |
| Pour Point, °F. | 115 |
| Neut. No. | 0.14 |
| Aniline Point, °F. | 191.4 |
| Refraction Index, 70° C. | 1.5074 |

The experiment was run as described in Example 1. These data for 250% Vol. furfural dosage at 225° F. show the effect of the addition of sodium dodecylbenzene sulfonate on the extraction process. Without the sulfonate the yield of raffinate was about 48.5% by volume of the distillate. With the sulfonate, however, an increase in this yield was observed. For example, a 0.005% wt. sulfonate concentration increased the raffinate yield by 2% Vol. and a 0.04% Wt. sulfonate concentration shows a further 2.5% increase to 53.0% volume. This 4.5% increase to the distillate represents a 9.3% by volume yield increase to the raffinate. At a concentration of 0.08% by wt. of sulfonate in the furfural, no further raffinate yield improvement was observed.

During the extraction tests, we observed the interface of the raffinate and extract phases and noted the formation of a flocculant black material at the interface. In extractions which included the sulfonate, we found that the black material was reduced in quantity at the interface and the appearance of the interface was cleaner and clearer. Although we did not quantify this observation, we concluded that the sulfonate has this further beneficial effect on the definition of the two phases.

The data in Table 5 show that the quality of the extracts, as measured by their API gravities (which show a decrease), the aniline points, (which also show a decrease) has improved, i.e., is shown to be more aromatic. Also, this increase in aromaticity is confirmed by the refractive indices, at 70° C., which also increase for extractions in which the sulfonate was added to the solvent.

TABLE 5

FURFURAL EXTRACTION OF THE DISTILLATE AT 225° F. and 250% VOL. FURFURAL IN A CONTINUOUS 17 MM ID COLUMN

| % Wt. Additive in Solvent | Solvent Free Product | Yield % Vol. to Distillate | Gravity °API | Aniline Point, °F. | Refractive Index at 70° C. |
|---|---|---|---|---|---|
| 0 | Raffinate | 48.5 | 28.2 | 237.0 | 1.4685 |
| | Extract | 51.5 | 9.9 | 122.4 | 1.5479 |
| 0.005 | Raffinate | 50.5 | 28.2 | 235.1 | 1.4683 |
| | Extract | 49.5 | 9.0 | 121.2 | 1.5501 |
| 0.02 | Raffinate | 51.0 | 28.5 | 238.2 | 1.4674 |
| | Extract | 49.0 | 9.3 | 118.4 | 1.5505 |
| 0.04 | Raffinate | 53.0 | 28.7 | 239.3 | 1.4670 |
| | Extract | 47.0 | 8.9 | 115.2 | 1.5539 |
| 0.08 | Raffinate | 53.0 | 28.2 | 237.2 | 1.4639 |
| | Extract | 47.0 | 8.1 | 116.0 | 1.5516 |

EXAMPLES 4 and 5

These Examples were run as outlined in Example(s) 3 above, using the 17 mm ID column. the distillate used was heavy neutral distillate, Arab Light, having the following properties:

TABLE 6

| | |
|---|---|
| Gravity, °API | 19.0 |
| Sp. Gravity, 60/60° F. | 0.9402 |
| Pour Point, °F. | 115 |
| Aniline Point, °F. | 178.8 |
| Neut. No. | <0.07 |

Table 7 summarizes the data obtained.

TABLE 7

FURFURAL EXTRACTION OF STOCK DISTILLATE AT 225° F. and 250% VOL. FURFURAL

| Example | Additive % Wt. | Solvent Free Product | Yield % Vol. to Distillate | Gravity, °API | Aniline Point, °F. |
|---|---|---|---|---|---|
| — | None | Raffinate | 52.2 | 28.9 | 240.2 |
| | | Extract | 47.8 | 9.3 | 118.0 |
| 4 | (a)/0.03 | Raffinate | 54.5 | 28.8 | 240.1 |
| | | Extract | 45.4 | 8.8 | 103.0 |
| 5 | (b)/0.005 | Raffinate | 53.9 | 28.8 | 241.1 |
| | | Extract | 46.1 | 9.4 | 112.3 |

(a)A commercially available sodium sulfonate of detergent alkylate (sodium dodecylbenzene sulfonate).
(b)Polyox - a water soluble polyethylene oxide resin having a molecular weight of about 4 million.

We claim:

1. In an improved method for producing lubricating oils by solvent extraction which comprises contacting a lube oil-containing hydrocarbon charge under conditions of solvent selectivity to permit the recovery of a raffinate phase which upon dewaxing will provide a lube oil product, the improvement whereby there is present in the extraction system from about 0.002% to about 0.2% by weight of the solvent of a metal or ammonium alkylbenzene sulfonate to facilitate phase separation and to increase raffinate yield, the solvent being selected from the group consisting of furfural, phenol, cresilic acid and sulfur dioxide, wherein the metal is selected from sodium and Group IIB of the Period Table, and the ammonium group has the formula $R'_4N^+$, wherein R' is hydrogen or a $C_1$–$C_6$ alkyl group.

2. The method of claim 1 wherein the alkyl of the alkylbenzene sulfonate contains from 1 to about 30 carbon atoms.

3. The method of claim 1 wherein the alkyl of the alkylbenzene sulfonate contains from 10 to about 20 carbon atoms.

4. The method of claim 1 wherein the alkyl of the alkylbenzene sulfonate is dodecyl.

5. The method of claim 1 wherein the alkylbenzene sulfonate is the sodium alkylbenzene sulfonate.

6. The method of claim 1 wherein the alkylbenzene sulfonate is the ammonium alkylbenzene sulfonate, as defined therein.

7. The method of claim 1 wherein the solvent is furfural.

8. The method of claim 1 wherein the alkylbenzene sulfonate is the zinc alkylbenzene sulfonate.

* * * * *